United States Patent [19]

Bengtson

[11] Patent Number: 4,615,552

[45] Date of Patent: Oct. 7, 1986

[54] FLETCHING FOR STABILIZING ARROW FLIGHT

[76] Inventor: Bjorn R. Bengtson, Box 71, S-124 21 Bandhagen 1, Sweden

[21] Appl. No.: 696,213

[22] Filed: Jan. 29, 1985

[51] Int. Cl.[4] ..... F41B 5/02

[52] U.S. Cl. ..... 273/423; 244/324

[58] Field of Search ..... 273/423, 420; 244/3.24–3.3; D22/12, 5

[56] References Cited

U.S. PATENT DOCUMENTS

| | | | |
|---|---|---|---|
| D. 172,821 | 8/1954 | Cass | D22/12 |
| D. 232,356 | 8/1974 | Melton | D22/12 |
| 1,360,602 | 11/1920 | Van Deuren | 244/3.24 |
| 1,883,758 | 10/1932 | Brandt . | |
| 2,830,818 | 4/1958 | Otto | 273/423 |
| 2,882,055 | 4/1959 | Meyer | 273/423 |
| 2,887,319 | 5/1959 | Lay | 273/423 |
| 2,976,043 | 3/1961 | Meyer | 273/423 |
| 3,085,511 | 4/1963 | Donner . | |
| 3,424,460 | 1/1969 | Simpson . | |
| 3,667,758 | 6/1972 | Bengtsson | 273/423 |
| 4,151,997 | 5/1979 | Glovak et al. | 273/424 |
| 4,157,632 | 6/1979 | Everett | 273/424 X |
| 4,203,249 | 5/1980 | Bohm | 273/425 |
| 4,477,084 | 10/1984 | Austin | 273/423 |

FOREIGN PATENT DOCUMENTS

| | | | |
|---|---|---|---|
| 514079 | 10/1939 | United Kingdom | 244/3.24 |
| 628041 | 8/1949 | United Kingdom | 273/423 |

*Primary Examiner*—Paul E. Shapiro

*Attorney, Agent, or Firm*—Pollock, Vande Sande & Priddy

[57] ABSTRACT

A fletching for guiding and stabilizing the flight of an arrow. The fletching has an outer vane portion providing a turbulent flow of air over this outer portion and an inner vane portion providing a laminar flow of air over this inner portion at flight velocity. The height of the smooth inner vane portion provides a moment arm for transmitting the effects of outer vane portion turbulence to the arrow shaft.

19 Claims, 19 Drawing Figures

FIG. 1
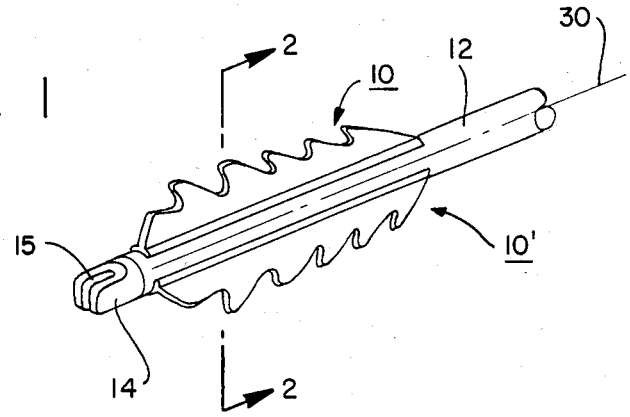
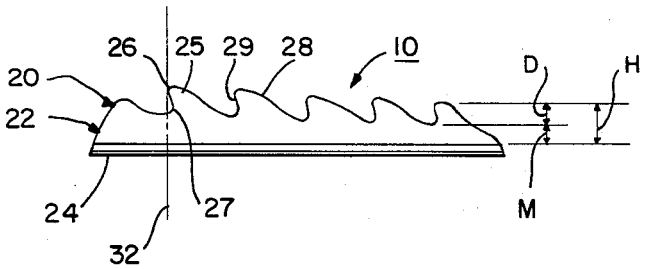
FIG. 3
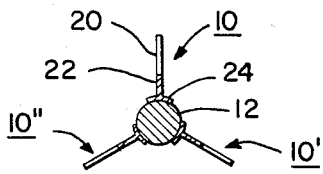
FIG. 2
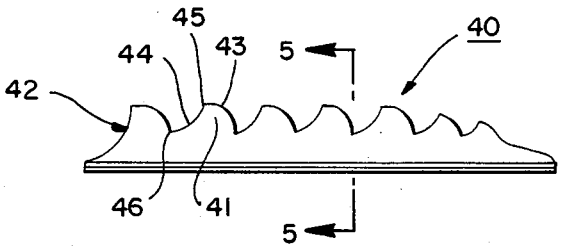
FIG. 4
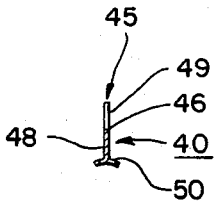
FIG. 5

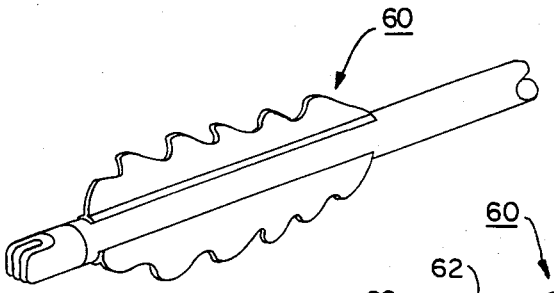
FIG. 6
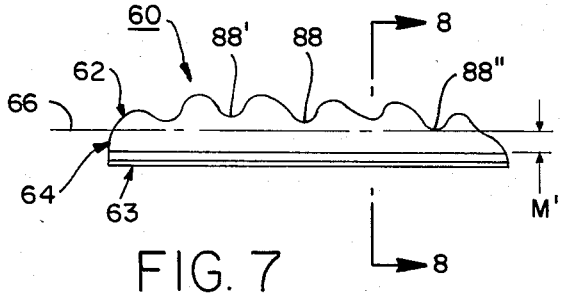
FIG. 7
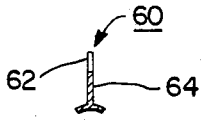
FIG. 8
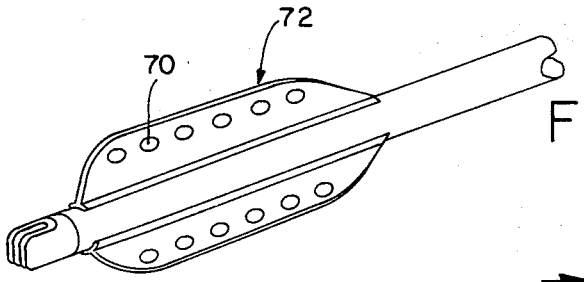
FIG. 9
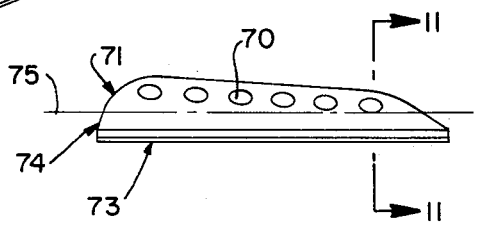
FIG. 10
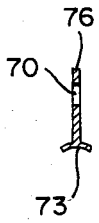
FIG. 11
FIG. 12
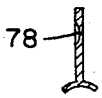
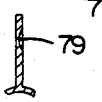
FIG. 13
FIG. 14
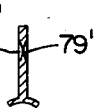
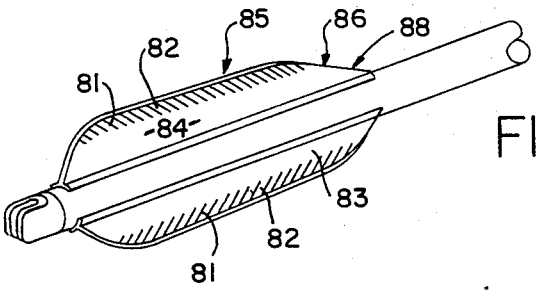
FIG. 15
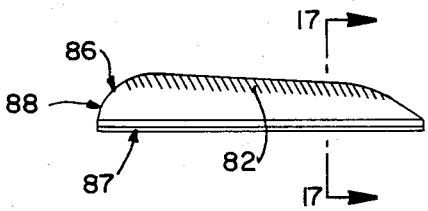
FIG. 16
FIG. 19
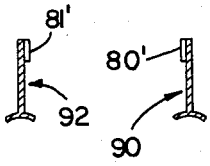
FIG. 18
FIG. 17
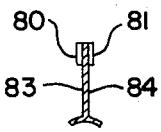

FLETCHING FOR STABILIZING ARROW FLIGHT

TECHNICAL FIELD

The present invention relates to vane structures for guiding the flight of projectiles, and more particularly to fletchings for guiding and stabilizing the flight of arrows when projected through the air by a bow.

BACKGROUND OF THE INVENTION

Arrows and similar free flying projectiles are guided in flight by the action of vanes or "fletchings" adjacent to the rear end thereof which usually has a nock with a slot for engaging the string of a bow. It has long been known in both target and hunting archery that the guiding vane or "fletching" is of great importance in establishing the ballistic characteristics of arrow type projectiles. These ballistics include a first phase when the arrow passes the handle of the bow which may include both an arrow rest for supporting the underside of the arrow shaft and a sight window framed by a portion of the handle that may contact one side or the other of the arrow shaft depending on whether the archer is right or left handed. The second ballistic phase is the flight of the arrow through the air after it leaves the bow and the third ballistic phase is the entrance of the arrow into the target. When a plurality of arrows are aimed at the same point on a target, the third ballistic phase is reflected by the "grouping" of these arrows in the target.

During the first ballistic phase, one or more of the fletchings may hit the arrow rest or the sight window frame portions of the bow handle because of various errors in the shooting of the arrow. Such errors may occur during the return of the string to its rest position as the arrow is shot by releasing the string while engaged by the nock. The arrow at the moment of the shooting receives its energy from the limbs of the bow as transmitted by the bow string and this causes the arrow shaft to bend slightly. After rolling over the fingertips of the archer during the release, the string returns to its rest position in an S-shaped curve. As the slightly bent arrow passes above the arrow rest and through the sight window, it often happens that an arrow fletching hits the arrow rest and/or the frame portion of the bow handle forming the sight window. This contact causes a deviation of the rear or nock end of the arrow shaft and may cause the arrow to wobble during its flight. An incorrect nock position at the time of arrow release may also cause or contribute to arrow wobble during flight. A wobble in the plane of the bow is known as "porpoising" and a wobble transverse to the plane of the bow is known as "fishtailing". The mechanical qualities of arrow fletchings are of vital importance in determining how quickly arrow wobble is dampened and how large will be the final deviation of the arrow tip from the point of aim when the arrow enters the target.

Arrow fletchings presently exist in many different forms. During the early development of archery, mainly bird feathers were used, although leaves, fibers and other kinds of natural materials were utilized. During the last 30 to 40 years, various kinds of synthetic materials such as plastics have come into use for the production of a wide variety of arrow fletchings. These synthetic fletchings can be divided into two main groups. The first group comprises stiff, thin vanes made from hard, rigid plastics or the like. The second group comprises pliable, usually slightly thicker vanes made from relatively soft, flexible plastics or the like with good recovery characteristics.

The thin, stiff vanes tend to have less air resistance and give the arrow a relatively flat trajectory which is advantageous when shooting at long distances. However, arrows with these fletchings have greater wobble in flight and larger deviations in grouping when they hit the arrow rest or the sight window frame of the bow handle.

On the other hand, arrows with fletchings made from pliable plastic materials have less wobble and less deviation in grouping upon interference between a fletching and the arrow rest or sight window frame. However, because they may be somewhat thicker, these vanes tend to have a somewhat greater air resistance. The transverse cross-section of pliable plastic vanes may be tapered so as to converge outwardly in order to reduce air resistance during flight and also to reduce the flight deviations produced when a fletching hits the arrow rest or the sight window frame.

Another problem that may occur with pliable plastic fletchings is that they may develop vibrations known as "flutter" along the outer border of the vane during flight of the arrow. Flutter along outer portions of the fletchings may cause the arrow to fall short or otherwise increase grouping deviations.

Outdoor target archery is usually practiced at distances between 30 and 90 meters. The corresponding distances for indoor target archery vary between 18 and 50 meters. In order to stabilize the arrow flight more quickly at the relatively short indoor distances, target arrows are often fletched with either larger plastic vanes or larger natural feathers, such as turkey feathers, than can be used at longer distances. The distance required for stabilization of the arrow after it leaves the bow, namely, the distance traveled before wobble or oscillations of the arrow shaft can be dampened out, may be 50 meters or more with conventional fletchings.

Fletchings made from natural feathers are believed to give quicker arrow stabilization because of their larger friction against the air, and also are regarded as being more "forgiving" in that they cause less flight deviations upon contact with the arrow rest or the sight window frame than either rigid or pliable types of conventional plastic fletchings. On the other hand, natural feathers vary considerably in thickness and stiffness and do not have the uniformity of plastic fletchings in this regard. Another problem with arrow fletchings made from natural feathers is that they lack the resistance of plastic fletchings to the deteriorating effects of humidity.

For target archery or hunting archery at longer distances (greater than about 50 meters), arrows are often fletched with smaller plastic vanes having relatively little air resistance. These small size plastic vanes also reduce flight deviations caused by side winds, which is an essential consideration at long distance shooting.

DISCLOSURE OF THE INVENTION

The invention provides a new structure for an arrow fletching, which may be made either from plastic or some other kind of suitable material whether natural or synthetic. The material may be either rigid or pliable, a pliable plastic such as polyurethane or cellulose acetatebutyrate (CAB) being preferred. At least three, and sometimes four or more, fletchings are mounted on the arrow shaft adjacent to a nock which the bow string engages at one end of the arrow shaft. The tip or penetrating point of the arrow is at the end of the shaft opposite to its nock end.

The new fletching has an elongated, relatively thin and substantially planar body with an inner edge portion, an inner vane portion, and an outer vane portion. The outer vane portion is shaped to provide a means for causing a turbulent flow of air over this outermost vane section of the fletching at flight velocity. This shaped portion is connected to the inner edge portion by the inner vane portion which is unperforated and has continuous, substantially smooth side surfaces for providing a laminar flow of air over this innermost vane section of the fletching at flight velocity. The smooth vane portion of the fletching provides a moment arm for transmitting to the arrow shaft the effects of the turbulence caused by the shaped outer portion. The amount of the turbulence and the length of the moment arm are selected such that the effects of the turbulence reaching the arrow shaft are sufficient to quickly stabilize the flight of the arrow after it leaves the bow. The inner edge portion has a transverse width sufficient to provide a base for mounting the fletching on an arrow shaft so that its elongated body extends longitudinally in the axial direction of the shaft.

The outer vane portion of the fletching may have a variety of shapes for causing turbulent air flow over this section of the fletching at flight velocity. One preferred embodiment is shaped to provide a wavy outer edge contour comprising a series of slightly rounded "saw-teeth" having peaks and valleys in the plane of the elongated fletching body. Other fletching embodiments include outer vane portions with a series of ribs, nodules, knobs or other protrusions projecting laterally from one or both sides of the outer vane body; or a series of holes projecting through the outer vane body from one side to the other; or a series of grooves or other indentations within one or both sides of the outer vane body. Where ribs or grooves or similarly elongated elements are provided as the turbulence generating means, these elements preferably extend transversely across the outer vane portion and are spaced apart one after the other in the longitudinal direction of the outer vane body, preferably at relatively close intervals.

The new fletchings stabilize an arrow within a substantially shorter distance from the bow than conventional fletchings of the same size class by quickly dampening oscillations of the arrow shaft after its release from the bow. The new fletchings also reduce the magnitude of the oscillations caused by contacts between a fletching and the arrow rest or the sight window frame. The flight of an arrow fletched with the vanes of the present invention is thus stabilized in a minimum period of time after the arrow leaves the bow. These arrow fletchings thus improve the guiding effect throughout the flight of the arrow from bow to target, especially where the fletchings are made of a soft, pliable material such as polyurethane.

Practical shooting tests to compare arrows fletched with conventional vanes with those fletched with vanes of the invention show that the invention stabilizes arrows more quickly and reduces the magnitude of oscillations and other flight deviations caused by contact between the fletching and the arrow rest or the sight window frame. The latter improvement is enhanced where the outer shape includes a planar "saw-tooth" projection or a lateral projection since contact may occur with only one of these projections. In other words, contact with only one such projection may deflect the nock end of the arrow so as to avoid further contact, while upon contact of a conventional fletching with the bow, the moment affecting the arrow is generated along almost the entire length of the vane. A similar improvement may be realized with the fletchings having holes or indentations along a path adjacent to their outer borders since these increase the flexibility of the outer vane portion so that contact generates less moment.

The improved stabilizing effects of the invention are provided by the turbulence producing shapes along or adjacent to the outer border of the vane. These cause a turbulent air stream which is oriented towards the outer portion of the vane. At the same time, the low surface friction of the smooth inner portion of the vane intermediate between the shaped outer portion and the base adjacent to the arrow shaft causes a laminar air stream which is oriented towards the portions of the fletching inwardly of the shaped outer portion. As a result of this combination, the smooth inner portion of the vane provides a moment arm for transmitting the effect of the outer turbulence to the shaft of the arrow. This moment effect is believed to provide the stabilizing qualities of the fletching of the present invention. The principal object of the invention therefore is to create a turbulent air stream which is oriented towards the outer portion of the fletching while minimizing the surface friction of those portions of the fletching between the turbulent air stream and the arrow shaft.

Another advantage of the fletching of the invention is that it reduces the effects of side winds which can cause the arrow to drift toward one side or the other during its flight from the bow to the target. For a given size arrow shaft, the fletchings made according to the present invention can be considerably smaller than conventional fletchings. In addition, the surface area of the side profile of the fletching may be reduced by removing those portions represented by the valleys of the "saw-tooth" embodiments of the fletching. Both of these factors reduce the projecting area of the fletching exposed to side winds so that such winds will produce less deviation of the arrow away from its intended flight path.

BRIEF DESCRIPTION OF THE DRAWINGS

The invention may be further understood from the description below of specific embodiments taken in conjunction with the accompanying drawings in which:

FIG. 1 is a perspective fragmentary view of an arrow shaft having fletchings according to the invention mounted adjacent to the nock end of the shaft.

FIG. 2 is a sectional view along lines 2—2 of FIG. 1.

FIG. 3 is a side elevational view of one of the fletchings of FIG. 1.

FIG. 4 is a side elevational view of another fletching embodiment according to the invention.

FIG. 5 is a sectional view along lines 5—5 of FIG. 4.

FIG. 6 is a perspective fragmentary view of an arrow shaft with another fletching embodiment according to the invention.

FIG. 7 is a side elevational view of one of the fletchings of FIG. 6.

FIG. 8 is a sectional view along lines 8—8 of FIG. 7.

FIG. 9 is a perspective fragmentary view of an arrow shaft with another fletching embodiment according to the invention.

FIG. 10 is a side elevational view of one of the fletchings of FIG. 9.

FIG. 11 is a sectional view along lines 11—11 of FIG. 10.

FIG. 12 is a sectional view similar to FIG. 11 but illustrating indentations along the left side of the fletching instead of apertures through the fletching.

FIG. 13 is a sectional view similar to FIG. 11 but illustrating indentations along the right side of the fletching instead of apertures through the fletching.

FIG. 14 is a sectional view similar to FIG. 11 but illustrating indentations along both sides of the fletching instead of apertures through the fletching.

FIG. 15 is a perspective fragmentary view of an arrow shaft having another fletching embodiment according to the invention.

FIG. 16 is a side elevational view of one of the fletchings of FIG. 15.

FIG. 17 is a sectional view along lines 17—17 of FIG. 16.

FIG. 18 is a sectional view similar to FIG. 17 illustrating ribs along the left side of the fletching instead of along both sides of the fletching.

FIG. 19 is a sectional view similar to FIG. 17 illustrating ribs along the right side of the fletching instead of along both sides of the fletching.

DESCRIPTION OF BEST MODE AND OTHER EMBODIMENTS

Referring to FIGS. 1, 2 and 3 of the drawing, there is shown a fletching having a body, generally designated 10, mounted on the shaft 12 of an arrow adjacent to a nock 14 having a slot 15. The bottom of slot 15 is engaged by the bow string when the arrow is shot into the air by a bow. Preferably three fletchings 10, 10′ and 10″ are mounted on arrow shaft 12 as shown in FIG. 2, although four or more fletchings may be used if desired.

Fletching 10 preferably comprises an outer contoured vane portion 20, an inner vane portion 22, and an inner edge portion forming a base 24 having a greater transverse width than vane portion 22. The contoured portion 20 creates turbulent airflow over this portion of the fletching at flight velocity. The inner vane portion 22 is unperforated and has continuous and sufficiently smooth side surfaces to provide laminar airflow over this portion of the fletching at flight velocity. The flight velocity at which these aerodynamic characteristics of the fletching portions 20 and 22 are realized is preferably in the range of about 50 to about 60 meters per second.

Fletchings 10, 10′ and 10″ are of identical construction so that only fletching 10 will be described in detail. Referring to FIG. 3, contoured portion 20 has a plurality of teeth 25 formed by a series of six rounded peaks 26 with five rounded valleys 27 interspersed therebetween. Each tooth 25 has a forward edge 28 and a rearward edge 29 inclined at different angles relative to the longitudinal axis 30 of arrow shaft 12. Except for the first and last teeth in the series, the forward edge 28 of one tooth joins the rearward edge 29 of the adjacent preceding tooth at the bottom of valley 27.

In the preferred fletching embodiment, the rearward edge of the majority of the teeth, namely all but the most rearward tooth, passes forwardly through an imaginary plane represented by broken line 32 which is perpendicular to the axis of the arrow shaft so that valley 27 undercuts peak 26 as best shown in FIG. 3. Portions of both the forward edge 28 and the rearward edge 29 preferably are inclined in the same direction relative to the axis of the arrow shaft and the maximum inclination of this portion of the forward edge is less than the maximum inclination of this portion of the rearward edge except for the most rearward tooth.

As measured from the top of peak 26 to the bottom of the underlying valley, the depth D of each valley is at least $\frac{1}{4}$, preferably $\frac{1}{3}$ to $\frac{2}{3}$, and more preferably about 40%, the total height H of the fletching vane above its base 24. The depths of the valleys are preferably substantially uniform and are critical to the invention in a number of respects. The valley depth D determines the amount of turbulent airflow along the contoured outer portion of the fletching. The depth D relative to the overall height H of the fletching also determines the length of the moment arm M provided by the smooth inner portion 22 of the vane between the valley bottoms 27 and fletching base 24. The depth D and also the tooth shape are both preferably chosen so that if the fletching contacts the arrow rest or the sight window frame, contact with only a single fletching "tooth" will position the arrow shaft so as to prevent further contact between the fletching and the bow. This also prevents contact between the bow and the continuous, unperforated inner vane portion 22 of the fletching.

Referring to FIGS. 4 and 5, the outer contoured portion of the fletching may have different "saw-tooth" shapes as illustrated by the periodic wave-form of contoured portion 42 of an alternative fletching 40. In this modified fletching, each tooth 41 has a convex forward edge 43 and a concave rearward edge 44 which intersect with the corresponding edges of adjacent teeth at a relatively sharp peak 45 and a relatively sharp valley bottom 46. The inclination of the rearward edge 44 relative to the axis 30 of the arrow shaft is in a direction opposite to the inclination of the forward edge 43 relative to the axis 30 of the arrow shaft.

As seen in FIG. 4, the rearward edge 44 does not undercut peak 45 and therefore fletching 40 differs in this respect from fletching 10 of which rearward edge 29 undercuts peak 26. Another difference between fletching 40 and fletching 10 is that the elongated opposing sides 48 and 49 of fletching 40 taper toward each other from base 50 to peak 45 as illustrated in FIG. 5. This inward aerodynamic taper of the transverse cross-section of the fletching body may be used with any of the fletching embodiments to increase the flexibility of the fletching body so as to further reduce arrow deviations caused by contact between a part of the fletching and the arrow rest or sight window frame of the bow.

The elongated sides of either fletching 10 or fletching 40 therefore may be either transversely tapered outwardly toward each other, or at substantially an equal transverse distance apart from each other (parallel) from the base outwardly to the outer contoured edge. As a further alternative, the sides of the fletching may be tapered over only an upper portion of their overall height (not shown). The degree of aerodynamic taper chosen may depend upon the degree of pliability of the material from which the fletching is made. Thus, no aerodynamic taper may be desirable where the fletching is made from a highly pliable material such as polyurethane. On the other hand, some relatively small degree of taper may be desirable where the fletching is made from a stiffer material such as cellulose acetatebutyrate. A greater amount of taper may be appropriate where harder plastics are used for the fletching.

FIGS. 6, 7 and 8 illustrate another periodic waveform for a "saw-tooth" contoured portion 62 of an alternative fletching 60. Contoured outer vane portion 62 is connected to base 63 by inner vane portion 64. A broken line 66 indicates generally the dividing line between the outer vane portion 62 and the smooth inner vane portion 64. In this embodiment, the peaks and valleys are both rounded and the valleys do not undercut the peaks. This embodiment also illustrates that the bottoms of the valleys may be of different heights above base 63, such as valleys 88 and 88'. For this reason, the height of moment arm M' is taken as the distance between the base and the lowest valley, namely valley 88''. In this embodiment, the fletching body is tapered from base to peak as illustrated by the transverse cross-section of FIG. 8.

Referring to FIGS. 9, 10 and 11, the turbulence producing function of the saw-tooth contours of FIGS. 1–8 is provided by a series of apertures 70 spaced at intervals along a longitudinal path within the outer vane portion 71 of an alternative fletching 72. Outer vane portion 71 is connected to a base 73 by a smooth and continuous inner vane portion 74. The transition between outer portion 71 and inner portion 74 of the vane is represented by a broken line 75. As illustrated by the cross-section of FIG. 11, the body of fletching 72 has substantially no taper from base 73 to outer periphery 76.

As illustrated in FIGS. 12–14, respectively, the turbulence provided by apertures 70 may instead be provided by a series of indentations or pockets 78 along the left side, or a series of indentations or pockets 79 along the right side, or a series of indentations or pockets 78' and 79' along both sides of the fletching body.

In the embodiments of FIGS. 15–17, the turbulence producing function of the saw-tooth contours of FIGS. 1–8 is provided by a series of laterally projecting ribs 80 and 81 at closely spaced intervals 82 along opposite sides 83 and 84, respectively, of a fletching 85. The ribs 80 and 81 provide a rough outer vane portion 86 connected to a base 87 by a smooth inner vane portion 88.

As illustrated in FIGS. 18 and 19, respectively, a stabilizing turbulence may be provided by a series of ribs 80' on the left side of a tapered fletching body 90 or a series of ribs 81' on the right side of a tapered fletching body 92. Although the turbulence provided by ribs on only one side of the fletching body may be less than the turbulence provided by ribs on both sides of the fletching body, the amount of turbulence produced by ribs on only one side is sufficient to provide the advantages of the invention. In addition, turbulence on only one side of the vane may cause rotation of the arrow shaft which may provide additional in-flight stability.

The ribs shown in FIGS. 15–19, have a relatively narrow elongated shape and extend longitudinally in a direction transverse to the elongated body of the fletching. As shown in FIGS. 15 and 16, these elongated ribs are preferably sloped at an angle to the axis of the arrow shaft. However, the invention may be practiced using protuberances having other shapes extending laterally from the fletching body, such as rounded bumps, knobs, nodules and the like.

What is claimed is:

1. A fletching for guiding and stabilizing the flight of an arrow projected through the air by a bow having a string which engages a nock at one end of the arrow shaft, said fletching having an elongated, relatively thin and substantially planar body comprising:

an inner edge portion of sufficient transverse width to provide a base for mounting the fletching on said arrow shaft so that said elongated body extends longitudinally in the axial direction of the shaft;

an outer vane portion extending radially in the plane of said elongated fletching body to an outer edge and having a plurality of turbulence means extending along said outer vane portion for providing a turbulent flow of air oriented substantially over said outer vane portion at flight velocity, the radial extent of said outer vane portion defining a width that is substantially uniform for a major proportion of the length of said elongated fletching body and is at least $\frac{1}{4}$ the height of said fletching body as measured from said base; and, an inner vane portion extending radially between said outer vane portion and said base for a predetermined height in the plane of said elongated fletching body, said predetermined height being at least $\frac{1}{3}$ the height of said fletching body as measured from said base;

said inner vane portion having substantially flat side surfaces and said base and said inner vane portion having continuous and substantially smooth side surfaces for providing a laminar flow of air oriented substantially over said inner vane portion at flight velocity;

the radial extent of said inner vane portion defining a width that is substantially uniform for a major proportion of the length of said elongated fletching body;

said width of said smooth inner vane portion providing a moment arm for transmitting the effects of said turbulence to said arrow shaft;

and the amount of said turbulence and the length of said moment arm being sufficient to quickly stabilize the flight of said arrow after it leaves the bow when at least three of said fletchings are mounted on said shaft adjacent its nock end.

2. The fletching of claim 1 in which said fletching is made from an elastomeric material.

3. The fletching of claim 1 in which said flight velocity is in the range of 50 to 60 meters per second.

4. The fletching of claim 1 in which said fletching body has opposing elongated sides that are at substantially an equal transverse distance from each other outwardly from said base to the outer edge of said outer vane portion.

5. The fletching of claim 1 in which said turbulence means comprises a series of apertures extending through and spaced at longitudinal intervals along said outer vane portion.

6. The fletching of claim 1 in which said fletching is made from a rigid plastic material.

7. A fletching for guiding and stabilizing the flight of an arrow projected through the air by a bow having a string which engages a nock at one end of the arrow shaft, said fletching having an elongated, relatively thin and substantially planar body comprising:

an inner edge portion of sufficient transverse width to provide a base for mounting the fletching on said arrow shaft so that said elongated body extends longitudinally in the axial direction of the shaft;

an outer vane portion having turbulence means for providing a turbulent flow of air over said outer vane portion at flight velocity, said turbulence means comprising a contoured outer edge forming a plurality of saw-teeth providing a series of peaks and valleys in the plane of said fletching body, and said valleys having a depth of at least $\frac{1}{4}$ the height of said fletching body as measured from said base; and an inner vane portion extending between said outer vane portion and said base for a predetermined height, and having continuous and substantially smooth side surfaces for providing a laminar flow of air over said inner vane portion at flight velocity, the height of said smooth inner vane portion providing a moment arm for transmitting the effects of said turbulence to said arrow shaft, and the amount of said turbulence and the length of said moment arm being sufficient to quickly stabilize the flight of said arrow after it leaves the bow when at least three of said fletchings are mounted on said shaft adjacent its nock end.

8. The flething of claim 7 in which said contoured outer edge includes rearward edges extending between said peaks and said valleys, and in which at least a majority of said rearward edges extend forwardly through a plane perpendicular to the axis of said arrow shaft such that valleys corresponding to said forwardly extending rearward edges undercut corresponding peaks.

9. The fletching of claim 8 in which each of said undercut peaks has a forward edge and a rearward edge each inclined relative to the axis of said arrow shaft and the maximum inclination of said forward edge is less than the maximum inclination of said rearward edge for at least a majority of said peaks.

10. A fletching according to claim 7 in which each of said peaks has a forward edge and a rearward edge each inclined relative to the axis of said shaft, and in which for at least a majority of said peaks the inclination of said rearward edge is in the same direction as the inclination of said forward edge.

11. A fletching according to claim 7 in which each of said peaks has a forward edge and a rearward edge each inclined relative to the axis of said shaft, and in which for a majority of said peaks the inclination of said rearward edge is in a direction opposite to the inclination of said forward edge.

12. The fletching of claim 7 in which the depths of said valleys is substantially uniform.

13. The fletching of claim 7 in which the depths of said valleys are about $\frac{1}{3}$ to $\frac{2}{3}$ the height of said fletching body as measured from said base.

14. The fletching of claim 7 in which the depths of said valleys are about $\frac{1}{3}$ to $\frac{1}{2}$ the height of said fletching body as measured from said base.

15. A fletching for guiding and stabilizing the flight of an arrow projected through the air by a bow having a string which enages a nock at one end of the arrow shaft, said fletching having an elongated, relatively thin and substantially planar body comprising:

an inner edge portion of sufficient transverse width of provide a base for mounting the fletching on said arrow shaft so that said elongated body extends longitudinally in the axial direction of the shaft;

an outer vane portion having turbulence means for providing a turbulent flow of air over said outer vane portion at flight velocity, said turbulence means comprising a series of indentations spaced at longitudinal intervals along at least one side of said outer vane portion; and an inner vane portion extending between said outer vane portion and said base for a predetermined height which is at least 50% of the height of said fletching body as measured from said base, and having continuous and substantially smooth side surface for providing a laminar flow of air over said inner vane portion at flight velocity, the height of said smooth inner vane portion providing a moment arm for transmitting the effects of said turbulence to said arrow shaft, and the amount of said turbulence and the length of said moment arm being sufficient to quickly stabilize the flight of said arrow after it leaves the bow when at least three of said fletchings are mounted on said shaft adjacent it nock end.

16. The fletching of claim 15 in which said indentations are spaced longitudinally along both sides of said outer vane portion.

17. A fletching for guiding and stabilizing the flight of an arrow projected through the air by a bow having a string which engages a nock at one end of the arrow shaft, said fletching having an elongated, relatively thin and substantially planar body comprising:

an inner edge portion of sufficient transverse width to provide a base for mounting the fletching on said arrow shaft so that said elongated body extends longitudinally in the axial direction of the shaft;

an outer vane portion having turbulence means for providing a turbulent flow of air over said outer vane portion at flight velocity, said turbulence means comprising a series of protuberances spaced at longitudinal intervals along at least one side of said outer vane portion; and, an inner vane portion extending between said outer vane portion and said base for a predetermined height which is at least 50% of the height of said fletching body as measured from said base, and having continuous and substantially smooth side surfaces for providing a laminar flow of air over said inner vane portion at flight velocity, the height of said smooth inner vane portion providing a moment arm for transmitting the effects of said turbulence to said arrow shaft, and the amount of said turbulence and the length of said moment arm being sufficient to quickly stabilize the flight of said arrow after it leaves the bow when at least three of said fletchings are mounted on said shaft adjacent its nock end.

18. The fletching of claim 17 in which said protuberances are spaced longitudinally along both sides of said outer vane portion.

19. A fletching for guiding and stabilizing the flight or an arrow projected through the air by a bow having a string which engages a nock at one end of the arrow shaft, said fletching having an elongated, relatively thin and substantially planar body comprising:

an inner edge portion of sufficient transverse width to provide a base for mounting the fletching on said arrow shaft so that said elongated body extends longitudinally in the axial direction of the shaft;

an outer vane portion having turbulence means for providing a turbulent flow of air over said outer vane portion at flight velocity, said turbulence means comprising a series of apertures extending through and spaced at longitudinal intervals along said outer vane portion; and, an inner vane portion extending between said outer vane portion and said base for a predetermined height which is at least 50% of the height of said fletching body as measured from said base, and having continuous and subtantially smooth side surfaces for providing a laminar flow of air over said inner vane portion at flight velocity, the height of said smooth inner vane portion providing a moment arm for transmitting the effects of said turbulence to said arrow shaft, and the amount of said turbulence and the length of said moment arm being sufficient to quickly stabilize the flight of said arrow after it leaves the bow when at least three of said fletchings are mounted on said shaft adjacent its nock end.

* * * * *